US005499461A

United States Patent [19]

Danezin et al.

[11] Patent Number: 5,499,461

[45] Date of Patent: Mar. 19, 1996

[54] BOOT FOR GUIDING SPORTS

[75] Inventors: Bruno Danezin, Chilly; Joël Bourdeau, Saint-Jorioz, France; Olivier Senee, Pringy, all of France

[73] Assignee: Salomon S.A., Metz-Tessy, France

[21] Appl. No.: 193,418

[22] Filed: Feb. 7, 1994

[30] Foreign Application Priority Data

Mar. 24, 1993 [FR] France ..... 93 03550

[51] Int. Cl.[6] ..... A43B 5/04

[52] U.S. Cl. ..... 36/117; 36/119; 36/120; 36/121; 36/55

[58] Field of Search ..... 36/117, 118, 119, 36/120, 121, 10, 55

[56] References Cited

U.S. PATENT DOCUMENTS

| | | | |
|---|---|---|---|
| 2,660,812 | 12/1953 | Henke | 36/117 |
| 3,313,046 | 4/1967 | Werner et al. | 36/121 |
| 3,570,148 | 3/1971 | Morgan | 36/121 |
| 3,597,862 | 8/1971 | Vogel | 36/117 |
| 4,085,528 | 4/1978 | Delery | 36/121 |
| 4,505,055 | 3/1985 | Bergmans | 36/12 |
| 4,510,703 | 4/1985 | Eiteljorg | 36/117 |
| 4,534,123 | 8/1985 | Salomon et al. | 36/99 |
| 4,638,578 | 1/1987 | Eiteljorg, II | 36/119 |
| 4,899,465 | 2/1990 | Bleimhofer et al. | 36/12 |
| 4,905,385 | 3/1990 | Perrissoud | 36/120 |
| 4,914,839 | 4/1990 | Paris et al. | 36/119 |
| 4,944,100 | 7/1990 | Sartor et al. | 36/121 |
| 5,031,341 | 7/1991 | Paris et al. | 36/120 |
| 5,177,884 | 1/1993 | Rullier et al. | 36/117 |

FOREIGN PATENT DOCUMENTS

| | | |
|---|---|---|
| 0416437 | 3/1991 | European Pat. Off. . |
| 0514642 | 11/1992 | European Pat. Off. . |
| 2499376 | 8/1982 | France . |
| 2607368 | 6/1988 | France . |
| 2668072 | 4/1992 | France . |
| 1485813 | 9/1969 | Germany . |

*Primary Examiner*—Paul T. Sewell
*Assistant Examiner*—Marie D. Patterson
*Attorney, Agent, or Firm*—Sandler, Greenblum & Bernstein

[57] ABSTRACT

A boot for gliding sports, and more specifically, for "snowboarding". The boot includes two distinct zones with different characteristics and functions, including a first relatively rigid energy/power circuit, distributed with respect to the foot, so as to centralize the forces, and especially the front and rear supports or the torsion control, during practice of the sport, and a second relatively flexible, sensitive circuit independent of the energy/power circuit, and adapted to ensure comfort of the foot as well as transmission of information originating from the gliding member towards the ankle. Both of the circuits are affixed to a common reference element.

22 Claims, 3 Drawing Sheets

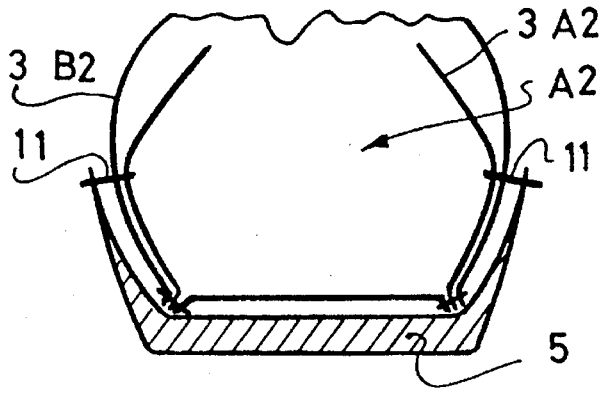
Fig: 5
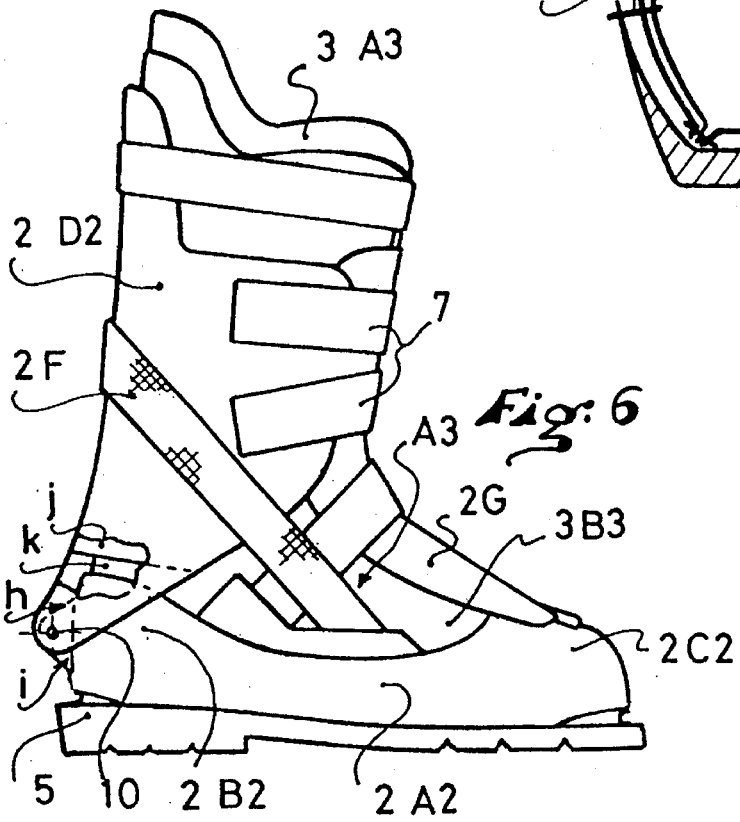
Fig: 6
Fig: 7
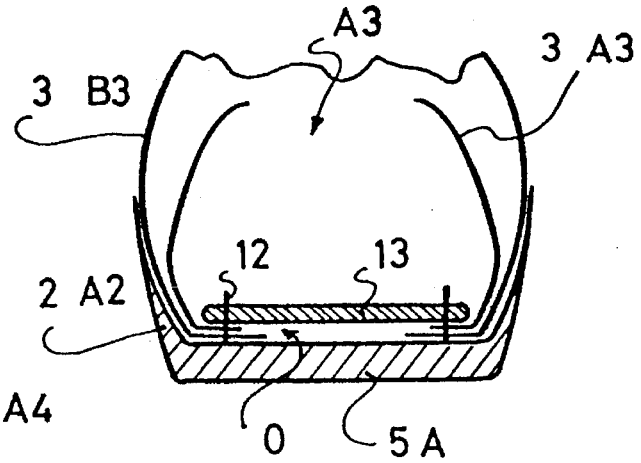
Fig: 8
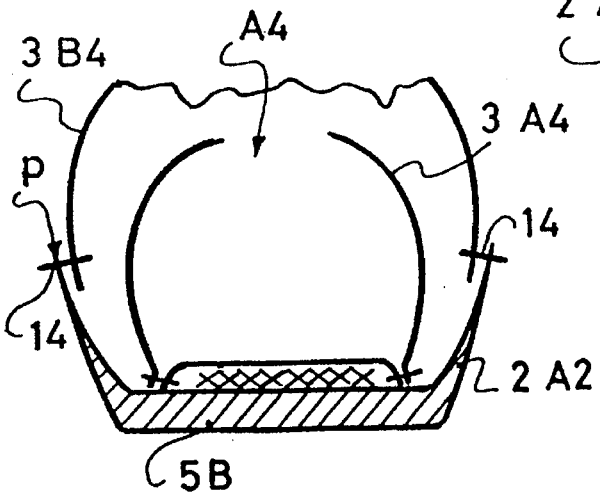

BOOT FOR GUIDING SPORTS

BACKGROUND OF THE INVENTION

1. Field of the Invention

The present invention concerns a boot intended for gliding sports, in which the foot is connected to the gliding device by means of a boot, and more specifically, a boot adapted to surfing on the snow or "snowboarding", or also to skating, ice skating, in-line skating, or skiing (cross country skiing, telemark, etc.).

2. Discussion of Background and Material Information

The practice of this type of sport has revealed problems linked to the construction of currently existing boots, which boots do not respond to the dynamic forces induced by these sports.

Indeed, it has been established that it is necessary to guarantee a certain comfort and flexible retention of the foot, and to enable it to take various positions according to situations encountered or desired during gliding.

On the other hand, it is also necessary to guarantee rigid support for the foot and lower part of the leg of the user. The support means must be strong, especially as the gliding member (skate, snowboard) is of a more substantial size and since the glide is most often undertaken in rapid fashion and according to more or less acrobatic figures/patterns.

In these conditions, the arms of the lever resulting from the dimensions of the gliding member induce forces that are sometimes very substantial on the foot or the lower part of the leg. Thus the foot and lower part of the leg must also be firmly maintained, frontwardly or rearwardly along the support axes, as well as laterally and in torsion. These firm maintenance requirements are contrary to the notion of comfort.

Currently, the market offers boots of either a flexible, rigid, or semi-rigid construction.

The flexible boots generally ensure retention of the foot by deformation of the upper (leather, fabric, flexible plastic), by bringing the latter close to the foot using a lacing system which tends to press the foot against the sole of the shoe, or yet by an internal tightening device, pressing the foot against the sole, independently of the external upper.

Rigid or semi-rigid boots, such as those developed for the alpine ski, as well as snowboard, ice skate, or in-line skate, comprise an internal liner arranged in a plastic or rigid leather shell, enveloping the foot and lower part of the leg.

The foot is then retained firmly by means of the liner, either by the relative deformation of the shell, which holds the liner and tends to immobilize it by means of external closure members of the shell, such as hooks and/or a collar on the lower part of the leg, or by internal tightening devices of the shell which also tend to immobilize the liner with respect to the sole, while spacing it from the shell by means of cables and support elements controlled from the outside of the boot by closure and adjustment members.

Each of the known types of boots mentioned above has its own, independent advantages and disadvantages.

Indeed, if the foot and the lower part of the leg are properly linked to the sole by virtue of the tightening obtained with the help of flexible materials, which provides good transmission of information originating from the gliding member, in return, the supports are not very strong because of the flexibility of the upper, which, in addition, can prove dangerous or fatiguing for the resistance of the foot and the lower part of the leg which will have to compensate for this lack of support by more substantial forces.

On the other hand, in rigid boots there is no lack of support to suffer but, on the contrary, the foot is less well retained in the boot due to possible relative movements between the shell and the liner, and thus between the liner and the sole, barring very considerable deformation of the shell on the liner, generating highly adverse pressures on the foot, and thus, considerable discomfort.

In other words, the support necessitates the use of rigid parts or elements which are not easily compatible with a specific adaptation to the morphology of the foot, which is necessary for a comfortable retention of the foot and for good transmission of information.

It has been demonstrated, according to a first phase of the inventive step, that all the problems cannot be treated together in the same zones of the boot and that consequently, they must be treated separately. The flexible retention of the foot and the lower part of the leg must not interfere with the rigid supports in order to limit the complexity of the boot to be perfected according to these criteria, and which is the object of the present invention.

SUMMARY OF THE INVENTION

To this end, the invention concerns a boot for gliding sports, such as skating, skiing, surfing or "snowboarding", wherein the boot is broken down into two distinct zones having different characteristics and roles:

one, constituting a relatively rigid energy/power circuit distributed with respect to the foot so as to centralize the forces, and especially the support of the foot (front and rear, or the torsion control) during practice of the sport;

the other, constituting a relatively flexible, sensitive circuit, independent of the energy/power circuit, and adapted to ensure comfort of the foot and transmission of information originating from the gliding member towards sensitive zones of the foot (ankle, upper portion of the foot);

both of the circuits being affixed to a common reference element.

In fact, in this way, the boot according to the invention combines the advantages of the flexible and rigid boots, while separating the geographic treatment of the two criteria sought: flexible foot retention and rigid foot support. Furthermore, the connection of each of the circuits to a common reference element enables the problems mentioned hereinabove regarding relative movements generating poor retention of the foot, to be overcome.

BRIEF DESCRIPTION OF THE DRAWINGS

The invention will be better understood, and other characteristics thereof will be shown by means of the following description, with reference to annexed, schematic drawings, illustrating as a non-limiting example, how the invention can be obtained and wherein:

FIG. 5 schematically represents a transverse section of the lower assembly zones of the various parts constituting the boot according to FIG. 4.

FIG. 6 represents a boot in accordance with the invention according to a variation of the embodiment.

FIG. 7 schematically represents a transverse section of the lower assembly zones of the various parts constituting the boot according to FIG. 6.

FIG. 8 schematically represents a transverse section of a variation of the assembly of the lower zones and of the various parts constituting the boot according to FIG. 4.

DETAILED DESCRIPTION OF THE PREFERRED EMBODIMENTS

Figure 1:
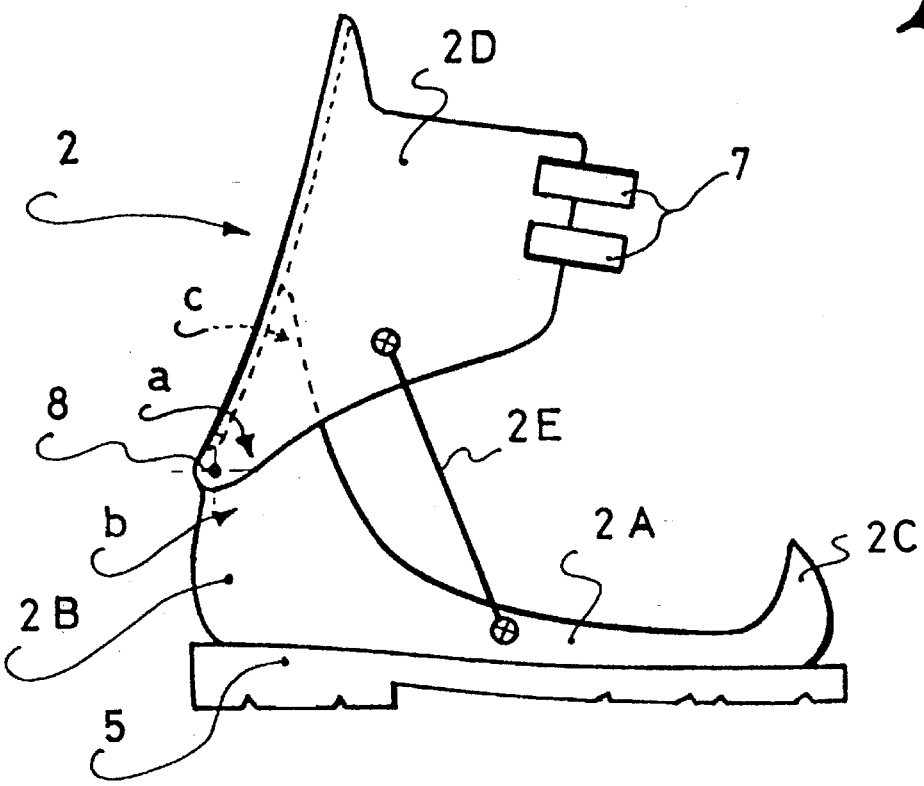
FIG. 1 schematically represents a single energy/power circuit, constituting a sub-assembly of a boot to be obtained according to the invention.
Figure 2:
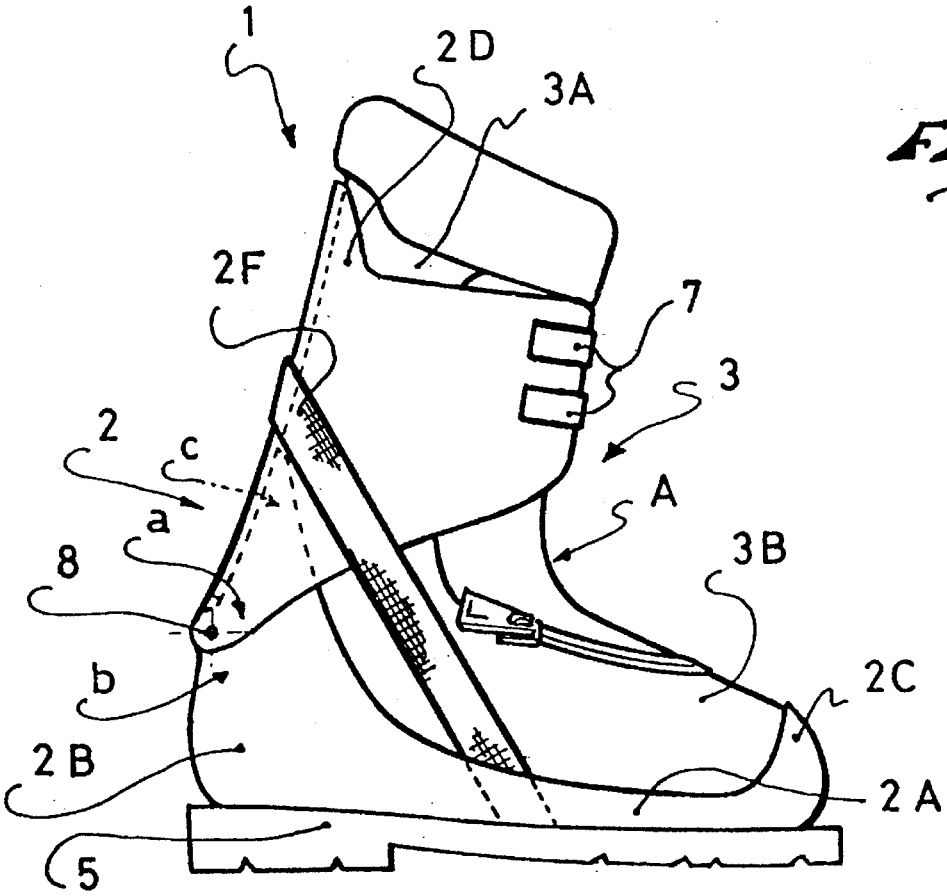
FIG. 2 represents a boot according to the invention, comprising an energy/power circuit according to FIG. 1 and a sensitive circuit, both circuits complementarily constituting the boot.

The gliding sport boot 1 identified in its entirety in FIGS. 1 and 2, is in this case, a boot intended for skating, ice skating, in-line skating, skiing (cross country skiing, telemark, etc.) or snowboarding.

On the one hand, it is generally comprised of a relatively rigid energy/power circuit (otherwise referred to herein as a support/control circuit) 2, 2A, 2B, 2C, 2D, 2E, 2F and 5, distributed with respect to the foot so as to centralize or consolidate the forces, and especially the front and rear support of the foot or the torsion control during practice of the sport, and on the other hand, by a relatively flexible, sensitive circuit 3, 3A, 3B, independent of the energy/power circuit (otherwise referred to herein as a comfort/sensing circuit), and adapted to ensure comfort of the foot and transmission of information originating from the gliding member (not represented in the drawing) towards the sensitive zones of the foot, and especially the ankle and upper portion of the foot. Both of circuits 2, 3 are fixed to a common reference element.

In this case, this common reference element is constituted by a relatively rigid sole 5 of boot 1, which is intended to be connected to the gliding member 4 and any other part adjoining this sole, forming an intrinsic part of the energy/power circuit.

Figure 4:
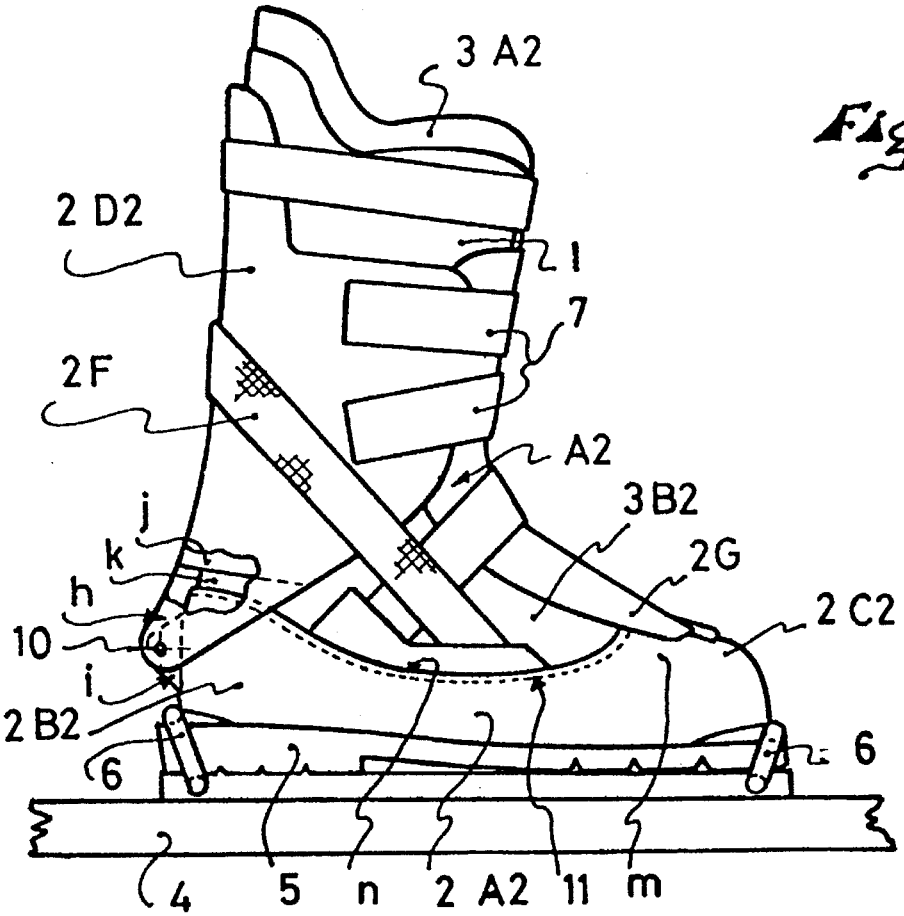
FIG. 4 represents a boot according to the invention, according to another embodiment.

Furthermore, sole 5 comprises hooking surfaces intended to cooperate with the binding means of gliding member 4, constituted for example, by the stirrups 6 (see FIG. 4).

As is particularly clearly represented in FIG. 1, the rigid energy/power circuit, in addition to sole 5, is constituted by a shell forming shoe 2A affixed to the sole 5, and comprising a rear stiffener 2B adapted to envelop the heel and a front stop 2C. The stiffener 2B is extended towards the ankle and the lower part of the leg by a collar 2D comprising tightening means 7 for the retention of the lower part of the leg.

Preferably, the collar 2D has a journal 8 at its lower rear portion a on an attached portion b of the stiffener 2B.

More specifically, in the example represented in FIGS. 1 and 2, the journal 8 is a rear transverse axle located in the zone a of the lower end of collar 2D and in the rear central zone b of stiffener 2B.

In the case of FIG. 1, the collar 2D is connected to shoe 2A or to sole 5 which is affixed thereto by at least one relatively rigid lateral tie rod 2E, for constituting a front or rear support of the leg according to the position of the leg with respect to the gliding member 4, so as to better control the forces and the lateral movements in torsion, and according to the rear and front movements of the collar 2D with respect to the shoe 2A.

According to a variation illustrated in FIG. 2, the collar 2D is connected to shoe 2A or sole 5 which is affixed thereto by at least one flexible strap 2F forming a bracing wire/guy adapted to constitute a tensional rear support, whereas the front support of the leg is obtained by an extension c towards the top of rear stiffener 2B of shoe 2A enveloping the heel, which extends beyond journal 8 of collar 2D. Thus, the corresponding portion a of collar **2*d*** is supported on the extension c in a rear-to-front flexional direction of the leg, to constitute the front support.

Figure 3:
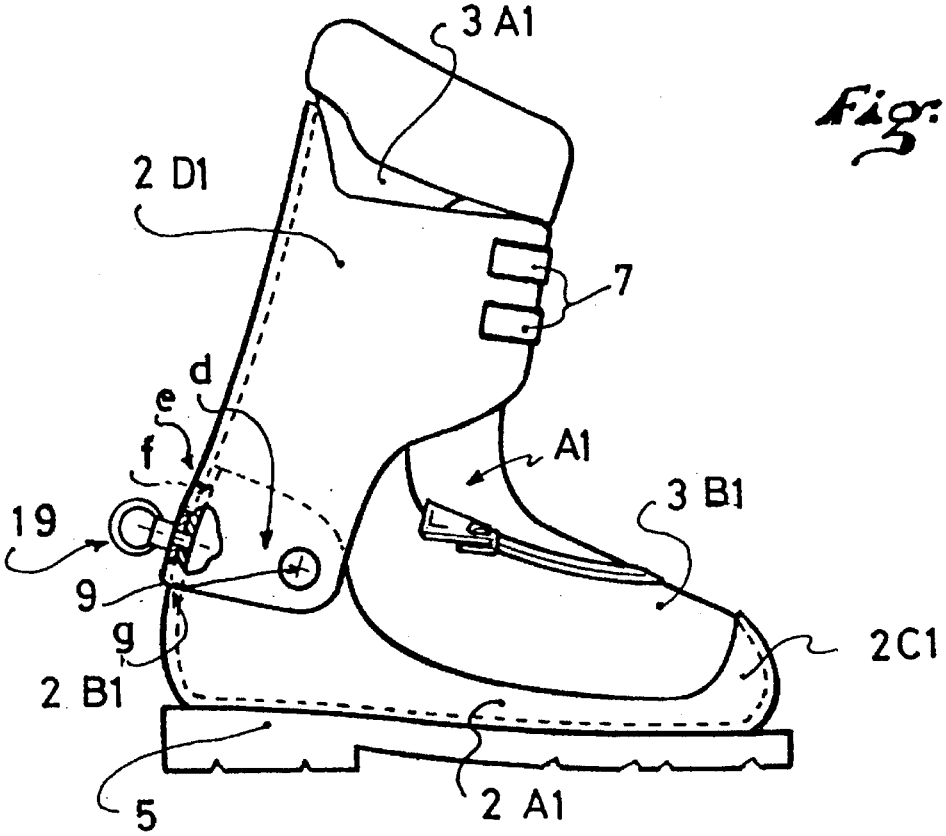
FIG. 3 represents a boot according to the invention, obtained according to another embodiment.

According to a variation of the invention illustrated in FIG. 3, the collar 2D1 is journalled at its lower portion d about two journal axes 9 located on the lateral portions of the rear stiffener 2B1 of shoe 2A1, in the malleoli zone of the foot, the front and rear supports being obtained by means of a linkage 19 between a rear portion e of said collar on a rear upper portion f of the stiffener. The connection between these two portions e, f is advantageously obtained by means of a removable pin 19, which enables opening of the collar by pivoting about its axes 9 for putting on the boots or for walking.

According to the variation of the invention represented in FIGS. 4 and 6, the collar 2D2 is journalled at its lower rear portion h on a journal axis 10 located at the rear of a zone i of the stiffener 2B2 of shoe 2A2. In this case, the front support is obtained by placing a lower edge j of collar 2D2 on an upper edge k of shoe 2A2, and the rear support is obtained by means of a tie rod inserted between shoe 2A2 and collar 2D2.

In the embodiment example of FIG. 4, the energy/power circuit further comprises a support located at the front of the boot which is constituted by a rigid tongue 2G arranged between a front portion l of collar 2D2 and an upper front portion m of shoe 2A2 forming an abutment. The tongue 2G cooperating with these portions l, m for the front support. In this case, the rigid tongue 2G is totally separated from the tightening of the leg and the foot obtained inside the boot, so as to neither interfere with the sensitive circuit nor the comfort.

Only the energy/power circuit of each boot 1 has been described above, but such boot is also constituted of a second zone, distinct from, but complementary to the first, to form the boot 1.

In reality, this second zone is constituted by the sensitive circuit which is formed by a flexible liner A, A1, A2, A3, A4 and 3A, 3A1, 3A2, 3A3, 3A4 (see FIGS. 1–7) enveloping the foot and the lower part of the leg. This liner is freely covered partially by the energy/power circuit 2A, 2B, 2C, 2D, 2E, 2F, 2G, 5 and, at least in its lower portion, by an external protective envelope 3B, 3B1 and 3B2, 3B3, 3B4 which is also relatively flexible, to form the upper A, A1, A2, A3, A4 of the boot in connection with the sole 5, 5A, 5B.

The sensitive circuit comprises an internal foot tightening device constituted by the lower portion of the liner 3A, 3A1, 3A2, 3A3, 3A4. This lower portion of the liner is affixed to sole 5 and tends to immobilize the foot with respect to sole 5A, 5B, according to a tightening force chosen with respect to the morphology of the foot and the comfort desired, so as to avoid any relative movement of the foot with respect to the sole 5, 5A, 5B, the assembly being covered by the protective envelope 3B, 3B1, 3B2, 3B3, 3B4.

According to FIGS. 4 and 5, the liner 3A2, constituting an internal tightening device, as well as the external protective envelope 3B2 contributing to form the upper A2, are connected simultaneously to an upper peripheral edge n, of shoe 2A2, forming the shell by means of a lateral stitch 11.

According to FIGS. 6 and 7, the liner 3A3 constituting an internal tightening device, is assembled previously by any linkage means 12 such as stitching or adhesion to a lower zone o of the protective envelope 3B3, contributing to form the upper A3, and possibly, an internal sole 13, the sub-assembly thus obtained then receiving the sole 5A by direct injection of a plastic material constituting a duplicate molding.

According to a variation illustrated in FIG. 8, the external protective envelope 3B4 contributing to form the upper A4 is connected to an upper peripheral edge p of shoe 2A2 forming the shell, by means of a lateral stitch 14 whereas the liner 3A4 constituting the internal tightening is fixed mechanically inside the shoe 2A2 in its zone forming the sole 5B by adhesion or screwing/nailing, for example.

Preferably, tightening at the level of the lower portion of the liner 3A1, 3A2, 3A3, 3A4, is obtained by lacing in a known fashion.

In the various cases described in connection with FIGS. 5, 7, and 8, the lower portion of the liner 3A2, 3A3, 3A4, constituting the internal tightening of the boot, is always rendered affixed to sole 5 or a portion, shell 2A, affixed thereto so as to obtain the common reference frame for both the sensitive and the energy circuits. The various parts 2, 2A, 2B, 2C, 2D, 2E, 2F, 5 of the energy/power circuit themselves are affixed to the sole 5 or the shell 2A constituting the common reference frame.

The instant application is based upon French patent publication No. 2,702,935, published on Sep. 30, 1994, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed:

1. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot, said rear stiffener having a rearward-facing upper surface;

a collar for receiving the lower leg, said collar extending above and overlapping said rear stiffener, said collar having a forward-facing lower surface;

a rear axle affixed to a rearward portion of said collar and a rearward portion of said rear stiffener for enabling a journalled movement of said collar in forward and rearward directions about an axis rearward of a wearer's heel;

said forward-facing lower surface of said collar engagable with said rearward-facing upper surface of said rear stiffener at a forward position of said collar to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole.

2. A boot according to claim 1, wherein:

said sole includes engagement surfaces adapted for connection with binding elements for securing the boot onto the gliding device.

3. A boot according to claim 1, wherein:

said comfort/sensing circuit comprises a flexible liner positioned within said collar and shell, and means for tightening the liner on the foot and the lower part of the leg, said liner being affixed to the sole.

4. A boot according to claim 3, wherein:

said comfort/sensing circuit comprises a flexible liner and an internal foot tightening device for immobilizing the foot with respect to said sole.

5. A boot according to claim 1, wherein:

said means for providing a rear support for the lower leg comprises a rigid lateral tie rod fixedly connected to said collar and fixedly connected with respect to said shell, said rigid tie rod thereby also comprising means for providing a rigid front support for the lower leg.

6. A boot according to claim 1, wherein:

said support/control circuit further comprises a rigid tongue arranged between and engaging a front portion of said collar and said front abutment of said shoe, said rigid tongue thereby comprising a further front support for the lower leg.

7. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot, said rear stiffener having a rearward-facing upper surface;

a collar for receiving the lower leg, said collar extending above and overlapping said rear stiffener, said collar having a forward-facing lower surface;

a rear axle affixed to a rearward portion of said collar and a rearward portion of said rear stiffener for enabling a journalled movement of said collar in forward and rearward directions about an axis rearward of a wearer's heel;

said forward-facing lower surface of said collar engagable with said rearward-facing upper surface of said rear stiffener at a forward position of said collar to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said means for providing a rear support for the lower leg comprises a flexible lateral strap fixedly connected to said collar and fixedly connected with respect to said shell and extending upwardly and rearwardly from a point of fixed connection with respect to said shell, whereby said flexible strap is tensioned during rear support.

8. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot, said rear stiffener having a rearward-facing upper surface;

a collar for receiving the lower leg, said collar extending above and overlapping said rear stiffener, said collar having a forward-facing lower surface;

a rear axle affixed to a rearward portion of said collar and a rearward portion of said rear stiffener for enabling a journalled movement of said collar in forward and rearward directions about an axis rearward of a wearer's heel;

said forward-facing lower surface of said collar engagable with said rearward-facing upper surface of said rear stiffener at a forward position of said collar to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said comfort/sensing circuit comprises a liner, said liner being positioned within said collar and said shell, and an external protective envelope, said liner and envelope forming a boot upper;

said shoe has an upper peripheral edge; and said liner and envelope are jointly connected to said upper peripheral edge of said shoe by means of stitching.

9. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot, said rear stiffener having a rearward-facing upper surface;

a collar for receiving the lower leg, said collar extending above and overlapping said rear stiffener, said collar having a forward-facing lower surface;

a rear axle affixed to a rearward portion of said collar and a rearward portion of said rear stiffener for enabling a journalled movement of said collar in forward and rearward directions about an axis rearward of a wearer's heel;

said forward-facing lower surface of said collar engagable with said rearward-facing upper surface of said rear stiffener at a forward position of said collar to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said comfort/sensing circuit comprises a liner, said liner being positioned within said collar and said shell, and an external protective envelope, said envelope having a lower zone and said liner being affixed to said lower zone, said liner and envelope forming a boot upper; and said liner and envelope are affixed to said sole by means of a plastic material constituting a duplicate molding.

10. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot, said rear stiffener having a rearward-facing upper surface;

a collar for receiving the lower leg, said collar extending above and overlapping said rear stiffener, said collar having a forward-facing lower surface;

a rear axle affixed to a rearward portion of said collar and a rearward portion of said rear stiffener for enabling a journalled movement of said collar in forward and rearward directions about an axis rearward of a wearer's heel;

said forward-facing lower surface of said collar engagable with said rearward-facing upper surface of said rear stiffener at a forward position of said collar to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said comfort/sensing circuit comprises a liner, said liner being positioned within said collar and said shell, and an external protective envelope, said liner and envelope forming a boot upper;

said shoe has an upper peripheral edge; and said envelope is connected to said upper peripheral edge of said shoe by means of stitching and said liner is fixed mechanically inside said shoe in an area of said sole.

11. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole adapted to connect the boot to the gliding device;

a shell in the form of a shoe affixed to said sole, said shoe comprising a front abutment for the front of the foot and a rear stiffener for enveloping the heel of the foot;

a collar for receiving the lower leg, said collar extending above and overlapping said rear stiffener;

a pair of journal axles, each connecting a lower lateral portion of an opposite lateral side of said collar and a respective lateral portion of said rear stiffener for enabling a journalled movement of said collar in forward and rearward directions, said journal axles extending along a common axis in an area of the malleoli of the foot;

a means for providing a front and rear support for the lower leg, said front support means comprising a manually removable linkage, said linkage comprising means for locking said collar in place against said journalled movement with respect to said rear stiffener, whereby upon removal of said removable linkage, said journalled movement is permitted for facilitating rearward movement of said collar for facilitating insertion of the foot within the boot and for facilitating walking while said foot is within the boot;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole.

12. A boot according to claim 11, wherein:

said manually removable linkage comprises means for facilitating grasping and pulling said linkage for removal from a locking position for permitting said collar to be freely journalled about said axis.

13. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot;

a collar for receiving the lower leg, said collar extending above and overlapping said rear stiffener;

a pair of journal axles, each connecting a lower lateral portion of an opposite lateral side of said collar and a respective lateral portion of said rear stiffener for enabling a journalled movement of said collar in forward and rearward directions, said journal axles extending along a common axis in an area of the malleoli of the foot;

a means for providing a front and rear support for the lower leg, said front support means comprising a manually removable linkage, said linkage comprising means for locking said collar in place against said journalled movement with respect to said rear stiffener, whereby upon removal of said removable linkage, said journalled movement is permitted for facilitating rearward movement of said collar for facilitating insertion of the foot within the boot and for facilitating walking while said foot is within the boot;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said comfort/sensing circuit comprises a liner, said liner being positioned within said collar and said shell, and an external protective envelope, said liner and envelope forming a boot upper;

said shoe has an upper peripheral edge; and said liner and envelope are jointly connected to said upper peripheral edge of said shoe by means of stitching.

14. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot;

a collar for receiving the lower leg, said collar extending above and overlapping said rear stiffener;

a pair of journal axles, each connecting a lower lateral portion of an opposite lateral side of said collar and a respective lateral portion of said rear stiffener for enabling a journalled movement of said collar in forward and rearward directions, said journal axles extending along a common axis in an area of the malleoli of the foot;

a means for providing a front and rear support for the lower leg, said front support means comprising a manually removable linkage, said linkage comprising means for locking said collar in place against said journalled movement with respect to said rear stiffener, whereby upon removal of said removable linkage, said journalled movement is permitted for facilitating rearward movement of said collar for facilitating insertion of the foot within the boot and for facilitating walking while said foot is within the boot;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/Control circuit and said comfort/sensing circuit being affixed to a common reference component of the boot, said common reference component comprising said sole, wherein:

said comfort/sensing circuit comprises a liner, said liner being positioned within said collar and said shell, and an external protective envelope, said envelope having a lower zone and said liner being affixed to said lower zone, said liner and envelope forming a boot upper; and said liner and envelope are affixed to said sole by means of a plastic material constituting a duplicate molding.

15. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot;

a collar for receiving the lower leg, said collar extending above and overlapping said rear stiffener;

a pair of journal axles, each connecting a lower lateral portion of an opposite lateral side of said collar and a respective lateral portion of said rear stiffener for enabling a journalled movement of said collar in forward and rearward directions, said journal axles extending along a common axis in an area of the malleoli of the foot;

a means for providing a front and rear support for the lower leg, said front support means comprising a manually removable linkage, said linkage comprising means for locking said collar in place against said journalled movement with respect to said rear stiffener, whereby upon removal of said removable linkage, said journalled movement is permitted for facilitating rearward movement of said collar for facilitating insertion of the foot within the boot and for facilitating walking while said foot is within the boot;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said comfort/sensing circuit comprises a liner, said liner being positioned within said collar and said shell, and an external protective envelope, said liner and envelope forming a boot upper;

said shoe has an upper peripheral edge; and said envelope is connected to said upper peripheral edge of said shoe by means of stitching and said liner is fixed mechanically inside said shoe in an area of said sole.

16. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot;

a collar for receiving the lower leg, said collar extending above and overlapping said rear stiffener;

a rear axle affixed to a rearward portion of said collar and a rearward portion of said rear stiffener for enabling a journalled movement of said collar in forward and rearward directions about an axis rearward of a wearer's heel;

said collar having a lower edge and said rear stiffener having an upper edge, said lower edge of said collar being engagable with said upper edge of said rear stiffener to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole.

17. A boot according to claim 16, wherein:

said means for providing a rear support for the lower leg comprises a rigid lateral tie rod fixedly connected to said collar and fixedly connected with respect to said shell, said rigid tie rod thereby also comprising means for providing a rigid front support for the lower leg.

18. A boot according to claim 16, wherein:

said support/control circuit further comprises a rigid tongue arranged between and engaging a front portion of said collar and said front abutment of said shoe, said rigid tongue thereby comprising a further front support for the lower leg.

19. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising, a front abutment for the front of the foot and a rear stiffener for enveloping the heel of the foot;

a collar for receiving the lower leg, said collar extending above and overlapping said rear stiffener;

a rear axle affixed to a rearward portion of said collar and a rearward portion of said rear stiffener for enabling a journalled movement of said collar in forward and rearward directions about an axis rearward of a wearer's heel;

said collar having a lower edge and said rear stiffener having an upper edge, said lower edge of said collar being engagable with said upper edge of said rear stiffener to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said means for providing a rear support for the lower leg comprises a flexible lateral strap fixedly connected to said collar and fixedly connected with respect to said shell and extending upwardly and rearwardly, whereby said flexible strap is tensioned during rear support.

20. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot;

a collar for receiving the lower leg, said collar extending above and overlapping said rear stiffener;

a rear axle affixed to a rearward portion of said collar and a rearward portion of said rear stiffener for enabling a journalled movement of said collar in forward and rearward directions about an axis rearward of a wearer's heel;

said collar having a lower edge and said rear stiffener having an upper edge, said lower edge of said collar being engagable with said upper edge of said rear stiffener to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said comfort/sensing circuit comprises a liner, said liner being positioned within said collar and said shell, and an external protective envelope, said liner and envelope forming a boot upper;

said shoe has an upper peripheral edge; and said liner and envelope are jointly connected to said upper peripheral edge of said shoe by means of stitching.

21. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot;

a collar for receiving the lower leg, said collar extending above and overlapping said rear stiffener;

a rear axle affixed to a rearward portion of said collar and a rearward portion of said rear stiffener for enabling a journalled movement of said collar in forward and rearward directions about an axis rearward of a wearer's heel;

said collar having a lower edge and said rear stiffener having an upper edge, said lower edge of said collar being engagable with said upper edge of said rear stiffener to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said comfort/sensing circuit comprises a liner, said liner being positioned within said collar and said shell, and an external protective envelope, said envelope having a lower zone and said liner being affixed to said lower zone, said liner and envelope forming a boot upper; and said liner and envelope are affixed to said sole by means of a plastic material constituting a duplicate molding.

22. A boot for a gliding sport, said boot comprising:

a support/control circuit and a comfort/sensing circuit, each of said circuits including separate structural components and independent functions;

said support/control circuit comprising relatively rigid structural components of the boot for consolidating forces transmitted between the gliding device and a foot and lower leg within the boot, said forces transmitted including rear support forces and front support forces for the foot and lower leg, said relatively rigid structural components of the boot comprising:

a relatively rigid sole;

a shell in the form of a shoe affixed to said sole, said shoe comprising a front abutment for the front of the foot and a rear stiffener for enveloping the heel of the foot;

a collar for receiving the lower leg, said collar extending above and overlapping said rear stiffener;

a rear axle affixed to a rearward portion of said collar and a rearward portion of said rear stiffener for enabling a journalled movement of said collar in forward and rearward directions about an axis rearward of a wearer's heel;

said collar having a lower edge and said rear stiffener having an upper edge, said lower edge of said collar being engagable with said upper edge of said rear stiffener to thereby comprise a front support for the lower leg;

means for providing a rear support for the lower leg;

means for tightening said collar against the lower leg; and said comfort/sensing circuit comprising relatively flexible structural components of the boot, said relatively flexible structural components of the boot comprising means for providing comfort of the foot and lower leg within the boot and transmission of information in a direction from the gliding member to sensitive zones of the foot and lower leg;

both said support/control circuit and said comfort/sensing circuit being affixed to a common reference component of the boot, said common reference component comprising said sole, wherein:

said comfort/sensing circuit comprises a liner, said liner being positioned within said collar and said shell, and an external protective envelope, said liner and envelope forming a boot upper;

said shoe has an upper peripheral edge; and said envelope is connected to said upper peripheral edge of said shoe by means of stitching and said liner is fixed mechanically inside said shoe in an area of said sole.

* * * * *